US009988770B1

(12) United States Patent
Beckhusen

(10) Patent No.: US 9,988,770 B1
(45) Date of Patent: Jun. 5, 2018

(54) IMPACT WEAR PLATES FOR VIBRATORY PLATE COMPACTOR

(71) Applicant: Caterpillar Inc., Peoria, IL (US)

(72) Inventor: Jordan Beckhusen, Robinson, TX (US)

(73) Assignee: Caterpillar Inc., Deerfield, IL (US)

( * ) Notice: Subject to any disclaimer, the term of this patent is extended or adjusted under 35 U.S.C. 154(b) by 0 days. days.

(21) Appl. No.: 15/367,775

(22) Filed: Dec. 2, 2016

(51) Int. Cl.
*E01C 19/34* (2006.01)
*E01C 19/38* (2006.01)
*E02D 3/046* (2006.01)

(52) U.S. Cl.
CPC ..... *E01C 19/34* (2013.01); *E01C 19/38* (2013.01); *E02D 3/046* (2013.01)

(58) Field of Classification Search
CPC ..... E01C 19/34; E01C 19/38; E01C 2301/00; E01C 19/30; E01C 19/22; E02D 3/046; E02D 3/02; E02D 3/00; F16F 15/08
See application file for complete search history.

(56) References Cited

U.S. PATENT DOCUMENTS 2,209,656 A * 7/1940 Mall ..... E01C 19/38 404/113
2,737,094 A 3/1956 Jackson
3,181,442 A * 5/1965 Brigel ..... E01C 19/38 404/113
3,508,476 A * 4/1970 Smith ..... E01C 19/405 280/446.1
4,698,926 A * 10/1987 Caplis ..... E01C 19/38 37/195
6,394,697 B1 * 5/2002 De Boer ..... E01C 19/38 404/133.05
9,284,695 B2 * 3/2016 Dulieu ..... E01C 19/34
2009/0035065 A1 * 2/2009 Gavins ..... E02D 3/074 404/114
2013/0251452 A1 * 9/2013 Steffen ..... E01C 19/35 404/133.05
2014/0064858 A1 * 3/2014 Paske ..... E02D 3/046 405/271

FOREIGN PATENT DOCUMENTS

| | | | |
|---|---|---|---|
| CN | 202610789 | U | 12/2012 |
| DE | 29500811 | U1 | 3/1995 |
| DE | 10355172 | B3 | 6/2005 |
| DE | 102008006889 | A1 | 4/2010 |
| GB | 2289490 | A | 11/1995 |

OTHER PUBLICATIONS

D. D. L. Chung; "Review Materials for Vibration Damping"; Journal of Materials Science (36); 2001; 5733-5737; Kluwer Academic Publishers.

* cited by examiner

*Primary Examiner* — Abigail A Risic
(74) *Attorney, Agent, or Firm* — Miller, Matthias & Hull

(57) ABSTRACT

A vibratory plate compactor. The vibratory plate compactor may comprise a base plate configured to vibrate and compact a work surface, and an upper yoke having at least one leg disposed above and facing the base plate. The vibratory plate compactor may further comprise an impact wear plate affixed to the bottom surface of the at least one leg. The impact wear plate may be unattached to the base plate, and may be at least partially formed from a non-metallic material.

20 Claims, 4 Drawing Sheets

IMPACT WEAR PLATES FOR VIBRATORY PLATE COMPACTOR

TECHNICAL FIELD

The present disclosure generally relates to vibratory plate compactors and, more specifically, to vibratory plate compactors having impact wear plates that absorb shock loads between upper and lower portions of the compactor.

BACKGROUND

Vibratory plate compactors may be used to compact and flatten a work surface such as soil, gravel, asphalt, or other work surfaces. A vibratory plate compactor may be manually operated, or may be an attachment on a larger, operator-controlled host machine such as an excavator, a mini-excavator, a backhoe, or a skid steer. When attached to a machine, the vibratory plate compactor may be attached to a free end of a boom that may be rotated, raised, or lowered to position the vibratory plate compactor on a selected work surface. A vibratory plate compactor may include an upper portion having an upper yoke, and a lower portion having a base plate that contacts the work surface and vibrates to compact the work surface. A vibration mechanism that includes an eccentric mass may be associated with the base plate to cause vibration of the base plate. To dampen vibrations from the base plate to the upper yoke, the vibratory plate compactor may further include isolator mounts connected between the upper portion and the lower portion of the compactor. The isolator mounts may include an elastomeric material absorbs vibrations to prevent the transmission of vibrations to the host machine.

The upper yoke of the vibratory plate tor may include legs having bottom surfaces that may strike the base plate as a downward force is applied on the compactor from the host machine. This may lead to wear at both the base plate and the upper yoke where contacts are made. To protect the legs of the upper yoke from damage, metal "feet" may be attached to the bottom surfaces of the yoke that strikes the base plate. While effective, the metal-metal contacts between the metal feet and the base plate may result in gouges, rust, and/or paint chipping at both the metal feet and the base plate where strikes occur.

German Patent Number DE10355172B3 discloses a compressor device for attachment to an excavator, wherein the compressor device includes an upper part, a lower part having a compressor plate, and a damping means interconnected between the upper part and the lower part to reduce the transmission of vibrations to the excavator. However, the compressor device does not include a mechanism for protecting the upper part and the compressor plate from damage when strikes occur between portions of the upper part and the compressor plate.

Thus, there is a need for improved strategies for protecting the upper yoke and the lower base plate of vibratory plate compactors from wear.

SUMMARY

In accordance with one aspect of the present disclosure, a vibratory plate compactor is disclosed. The vibratory plate compactor may comprise a base plate configured to vibrate and compact a work surface, and an upper yoke having at least one leg with a bottom surface disposed above and facing the base plate. In addition, the vibratory plate compactor may comprise an impact wear plate affixed to the bottom surface of the at least one leg of the upper yoke. The impact wear plate may be unattached to the base plate, and may be at least partially formed from a non-metallic material.

In accordance with another aspect of the present disclosure, a machine is disclosed. The machine may comprise an internal combustion engine, an undercarriage supporting tracks or wheels, a boom, and a vibratory plate compactor coupled to an end of the boom. The vibratory plate compactor may include a lower portion having a base plate, and a vibratory mechanism configured to vibrate the base plate. The vibratory plate compactor may further include an upper portion having an upper yoke with a plurality of legs each having bottom surfaces facing the base plate. The machine may further comprise a plurality of impact wear plates each affixed to the bottom surface of a respective one of the legs of the upper yoke. The impact wear plates may be formed from a non-metallic material.

In accordance with another aspect of the present disclosure, a machine configured to compact a work surface is disclosed. The machine may comprise an internal combustion engine, an undercarriage supporting tracks or wheels, a rotatable turntable configured to rotate with respect to the undercarriage, and a boom connected to the rotatable turntable. The machine may further comprise a vibratory plate compactor coupled to an end of the boom. The vibratory plate compactor may include a base plate, and a vibratory mechanism operatively associated with the base plate and configured to vibrate the base plate. The vibratory plate compactor may further comprise an upper yoke with at least one leg having a bottom surface facing the base plate, a metal backing plate affixed to the bottom surface of the leg, and an impact wear plate affixed to the metal backing plate. The impact wear plate may be formed from a wear-resistant material.

These and other aspects and features of the present disclosure will be more readily understood when read in conjunction with the accompanying drawings.

DETAILED DESCRIPTION

Figure 1:
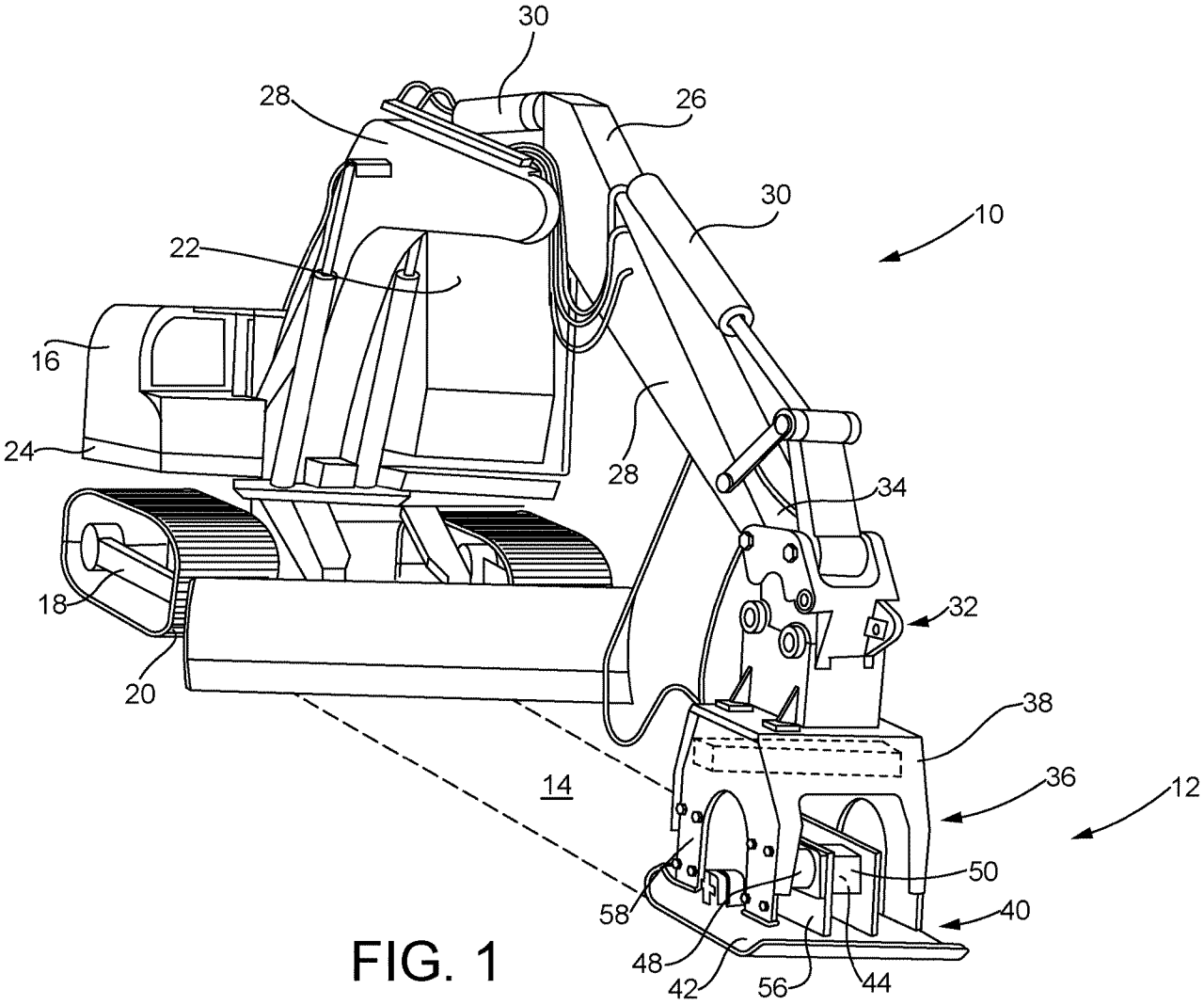
FIG. 1 is a perspective view of a machine having a vibratory plate compactor, constructed in accordance with the present disclosure.

Referring now to the drawings, and with specific reference to FIG. 1, a machine 10 having a vibratory plate compactor 12 is shown. The vibratory plate compactor 12 may be used to compact and flatten a work surface 14 which may include soil, asphalt, gravel, or other compactable materials. As non-limiting examples, the machine 10 may be an excavator, a mini-excavator, a backhoe, a skid steer, as well as other types of machines that may be fitted with a vibratory plate compactor. Alternatively, the vibratory plate compactor 12 may be separate from the machine 10 and may be manually operated, as will be understood by those with ordinary skill in the art.

The machine 10 may include an internal combustion engine 16 (or a motor, such as an electric motor) for powering the machine 10, an undercarriage 18 supporting tracks 20 (or wheels) for driving the movement of the machine 10, and an operator cab 22. In alternative arrangements, the machine 10 may be unmanned and may lack an operator cab. A rotatable turntable 24 may support the internal combustion engine 16 and the operator cab 22 and may be rotatable with respect to the undercarriage 18. Connected to the turntable 24 may be a boom 26 having linkage members 28 that are raised and lowered with hydraulic cylinders 30. A coupling device 32 may couple a free end 34 of the boom 26 to the vibratory plate compactor 12, as shown.

The vibratory plate compactor 12 may include an upper portion 36 having an upper yoke 38, and a lower portion 40 having a base plate 42 that vibrates to compact the work surface 14. Both the upper yoke 38 and the base plate 42 may be formed from or may include a metallic material such as a pure metal or a metal alloy. The lower portion 40 may also include a vibratory mechanism 44 having an eccentric mass 46 (see FIG. 2) that may rotate on a shaft to cause vibration of the base plate 42. Isolator mounts 48 may interconnect the upper portion 36 and the lower portion 40, and may dampen vibrations from the base plate 42 to the upper portion 36 in order to protect the machine 10 from excessive vibrations and resulting wear. In particular, the isolator mounts 48 may be attached to both the upper portion 36 and the lower portion 40 of the compactor 12.

Figure 2:
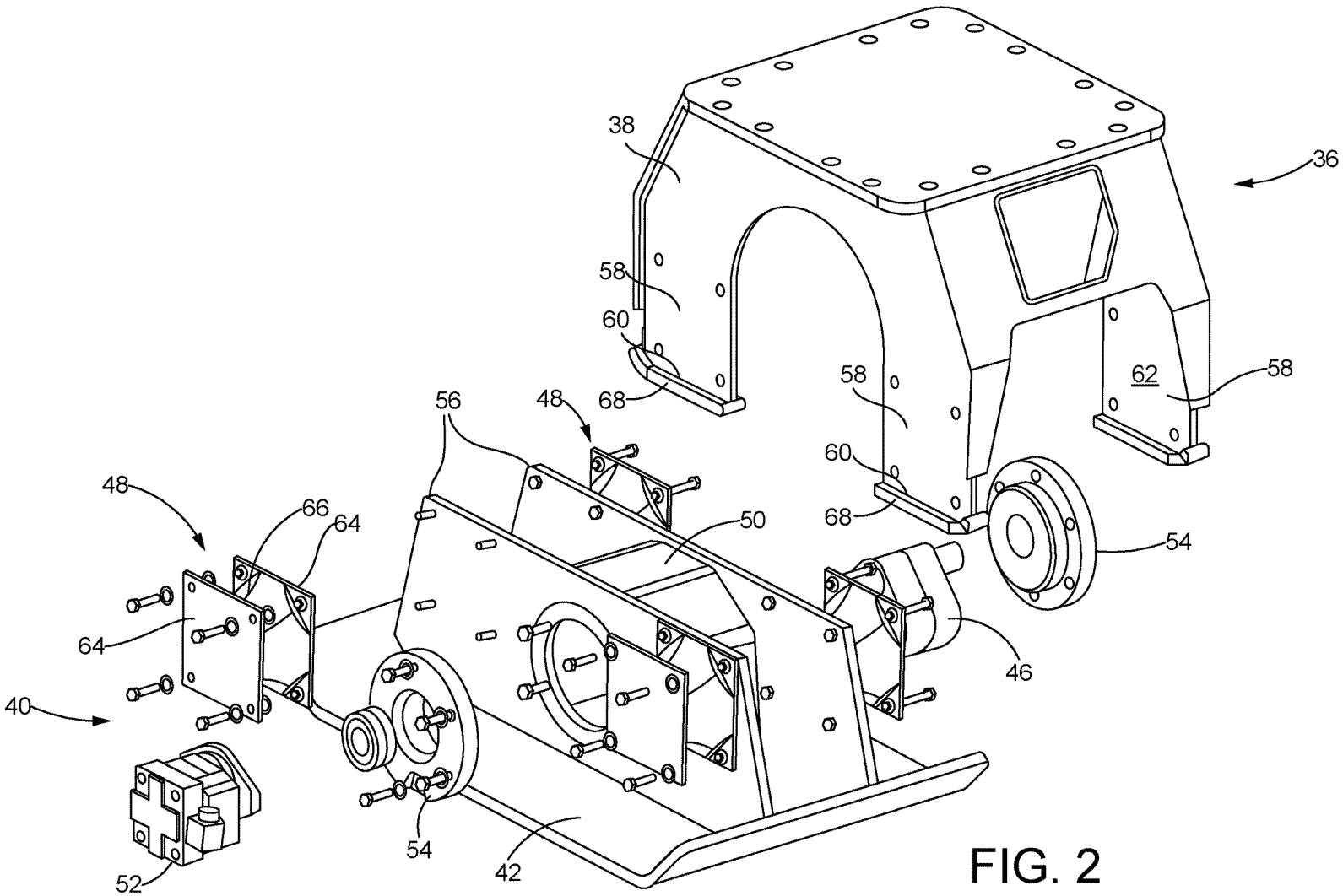
FIG. 2 is an exploded view of the vibratory plate compactor of FIG. 1 with some components removed for clarity, constructed in accordance with the present disclosure.

Turning now to FIG. 2, some of the components of the vibratory plate compactor 12 are shown in further detail. Attached to the base plate 42 may be a housing 50 that houses the vibratory mechanism 44. Specifically, the vibratory mechanism 44 may include the eccentric mass 46, and a vibratory motor 52 that may drive the rotation of the shaft on which the eccentric mass 46 is mounted to cause vibration of the base plate 42. The vibratory motor 52 may be a hydraulic motor powered by a hydraulic pump, or it may be an electric motor in other arrangements. The vibratory motor 52 may be supported in the housing 50 with bearings 54. In addition, one or more support plates 56 extending substantially perpendicular to the base plate 42 may be attached to or integrally formed with the housing 50 to support the housing 50 on the base plate 42. In alternative configurations, the support plates 56 may be angled with respect to the base plate, or the lower portion 40 may lack the support plates 56.

The upper yoke 38 may include one or more legs 58 that may extend substantially perpendicular to the base plate 42. In alternative configurations, the legs 58 may be angled with respect to the base plate 42. When the compactor 12 is assembled, the housing 50 and the support plates 56 may be disposed between the legs 58 (see FIG. 1). In one arrangement, the upper yoke 38 may have four legs 58, although it may have more or less legs in other configurations. Each of the legs 58 may have a bottom surface 60 that is disposed above and faces the base plate 42 when the compactor 12 is assembled. As explained in further detail below, the bottom surfaces 60 of the legs 58 may be poised to strike the base plate 42 when the base plate 42 is vibrating and a downward force is imposed on the compactor 12.

The isolator mounts 48 may be attached to the support plates 56 of the lower portion 40, and to inner surfaces 62 of the legs 58 of the upper portion 36. More specifically, each of the isolator mounts 48 may have two mounting plates 64, with one of the mounting plates 64 being attached to one of the support plates 56 of the lower portion 40, and the other mounting plate 64 being attached to the inner surface 62 of one of the legs 58 of the upper portion 36. In one arrangement, the mounting plates 64 may be bolted to the support plates 56 and the legs 58 using mechanical fasteners (e.g., bolts, rivets, etc.). In other arrangements, the mounting plates 64 may be attached to the support plates 56 and the legs 58 by other methods apparent to those skilled in the art such as, but not limited to, adhesive bonding, welding, or brazing. Between the two mounting plates 64 of each of the isolator mounts 48 may be a damping portion 66 formed from an elastomeric material capable of absorbing vibrational loads, such as natural rubber or a synthetic rubber. Although four isolator mounts 48 are shown in FIG. 2, the compactor 12 may have more or less isolator mounts in alternative configurations. In addition, in alternative arrangements, the isolator mounts 48 may be directly connected to the housing 50 of the lower portion 40 and/or to other portions of the upper yoke 38.

Affixed to the bottom surfaces 60 of one or more of the legs 58 of the upper yoke 38 may be impact wear plates 68 that absorb shock loads and prevent damage to the base plate 42 and the upper yoke 38 when strikes occur. As one possibility, each of the legs 58 of the upper yoke 38 may have one of the impact wear plates 68 affixed thereto. As explained in further detail below, the impact wear plates 68 may be formed from, or at least partially formed from, a wear-resistant and resilient material that resists damage when the upper yoke 38 and the base plate 42 strike each other. When damaged with extended use, however, the wear plates 68 may be removed and replaced with new wear plates. Moreover, the impact wear plates 68 may provide a hard stop that may limit the amount of movement of the base plate 42 to avoid overstressing the isolator mounts 48.

The impact wear plates 68 may be partially or fully formed from a non-metallic material. For example, the impact wear plates 68 may include or may be formed from one or more wear-resistant and/or elastomeric polymeric materials such as, but not limited to, polyurethane and natural rubber. Other suitable non-metallic polymeric materials may include, but are not limited to, polyimides, polyamides, polytetrafluoroethylene, a polypropylene/butyl rubber blend, a polyvinylchloride/chlorinated polyethylene/epoxidized natural rubber blend, polysulfones, and synthetic rubbers such as silicone rubbers, ethylene propylene diene monomer (EPDM) rubber, polychloroprene, and acrylic rubber.

Alternatively, the impact wear plates 68 may be formed from or may include vibration damping metals such as shape memory alloys (SMAs) or ferromagnetic alloys. Examples of SMAs may include, but are not limited to, copper-aluminum-nickel alloys, nickel-titanium alloys, or alloys of zinc, copper, gold, and iron. As other possibilities, the impact wear plates 68 may be formed from or may include soft metals such as aluminum, copper, brass, bronze, lead, gold, silver, tin, and zinc. Combinations of the aforementioned non-metallic materials and metallic materials may also be used in some circumstances.

Figure 3:
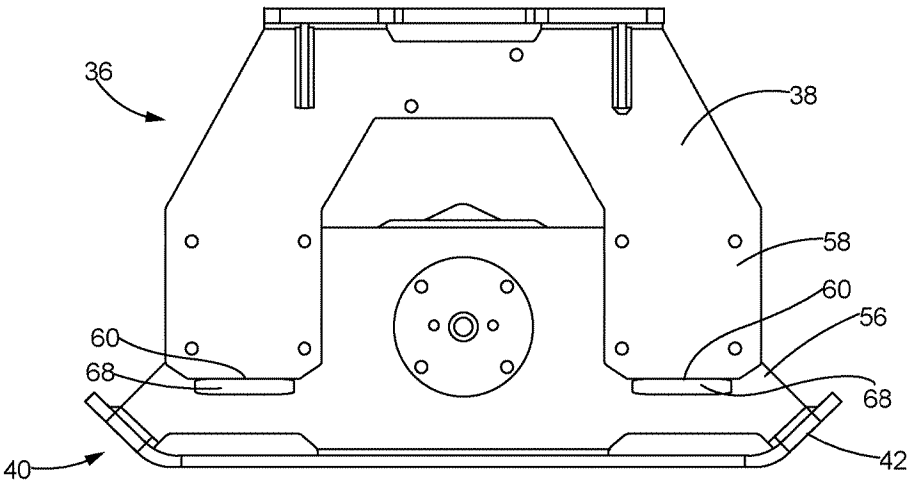
FIG. 3 is a side view of the vibratory plate compactor, illustrating impact wear plates attached to an upper yoke of the compactor, constructed in accordance with the present disclosure.

The impact wear plates 68 may have a bent configuration that is complementary to the bent geometries of the bottom surface 60 and the base plate 42 as shown in FIG. 2. Alternatively, as shown in FIG. 3, the impact wear plates 68 may have a flat geometry for attachment to the flat portion of the bottom surface 60. The impact wear plates 68 may be directly affixed to the bottom surfaces 60 of the legs 58 by adhesive bonding or by mechanical fastening with one or more mechanical fasteners (e.g., bolts, rivets, etc.), as will be understood by those with ordinary skill in the art. If attached with mechanical fasteners, the impact wear plates 68 may include one or more threaded or unthreaded apertures for insertion of the mechanical fastener(s) through the wear plates 68. If the impact wear plates 68 include metallic materials, metal bonding methods such as welding or brazing may also be used to affix the impact wear plates 68 to the bottom surfaces 60.

Figure 4:
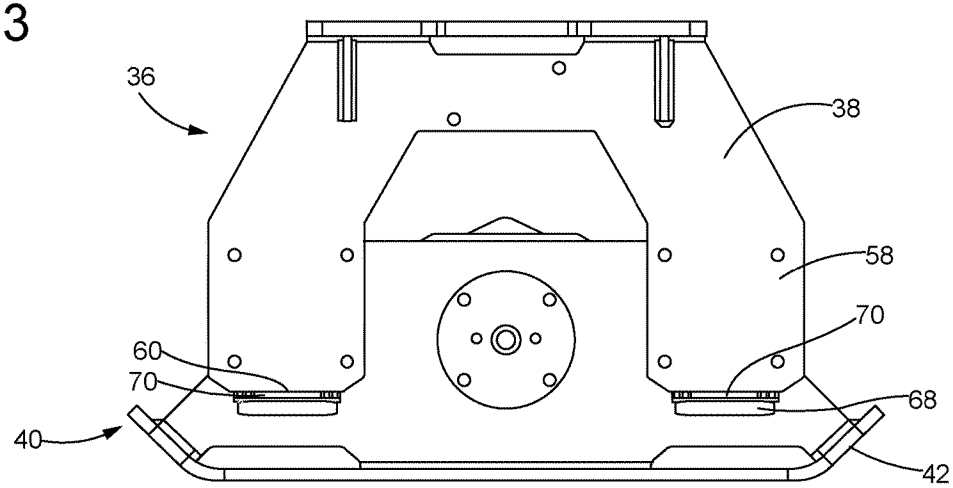
FIG. 4 is a side view similar to FIG. 3, but with the impact wear plates being attached to the upper yoke with backing plates, constructed in accordance with the present disclosure.

Alternatively, the impact wear plates 68 may each be affixed to one or more backing plates 70, and the assembly of the impact wear plate 68 and the backing plate 70 may be affixed to the bottom surface 60 with the backing plate 70 making direct contact with the bottom surface 60 (see FIG. 4). More specifically, the impact wear plate 68 may be affixed to the backing plate 70 (e.g., by adhesive bonding, mechanical fastening, welding, brazing, etc.), and the impact wear plate 68/backing plate 70 assembly may be affixed to the bottom surface 60 (e.g., by adhesive bonding, mechanical fastening, welding, brazing, etc.). If mechanical fastening is used, one or both of the impact wear plate 68 and the backing plate 70 may include threaded or unthreaded apertures for insertion of the mechanical fastener(s) therethrough. The backing plate 70 may be formed from a metallic material such as steel, although other metals and metal alloys may also be used.

The impact wear plate 68 may have a thickness ranging from about 30 millimeters (mm) to about 100 mm, and a length ranging from about 100 mm to about 500 mm. However, the wear plate 68 may have dimensions deviating from these ranges depending on the size of the machine 10 and/or the identity of the material making up the wear plate 68.

INDUSTRIAL APPLICABILITY

In general, the teachings of the present disclosure may find broad applicability in many industries including, but not limited to, construction, agriculture, and road maintenance industries. More specifically, the present disclosure may find applicability in any industry using machines or equipment that include a vibratory plate compactor.

Figure 5:
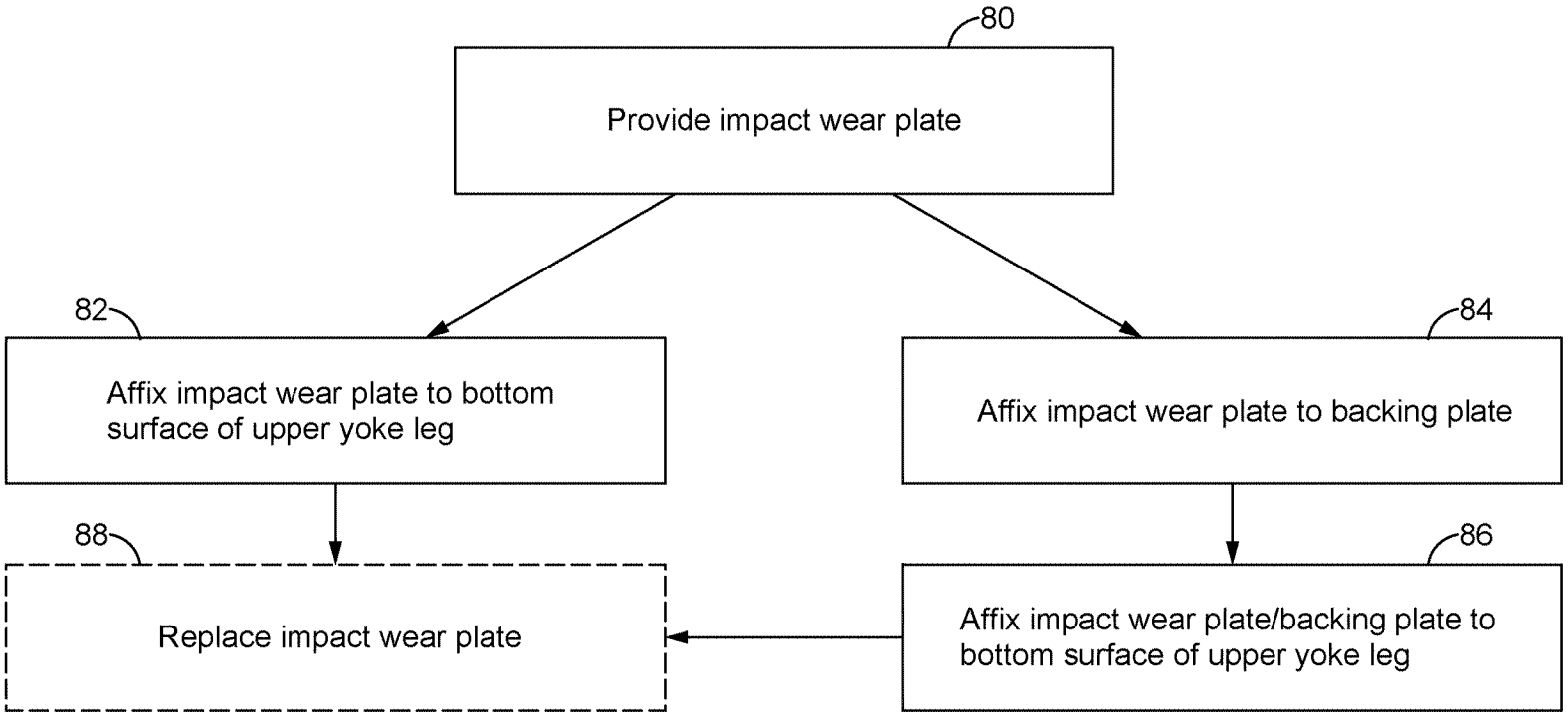
FIG. 5 is a flowchart of a series of steps that may be involved in installing the impact wear plates on the vibratory plate compactor, in accordance with a method of the present disclosure.

Referring to FIG. 5, a series of steps that may be involved in installing the impact wear plate 68 on the vibratory plate compactor 12 are shown. Beginning with a first block 80, the impact wear plate 68 may be provided in dimensions appropriate for the size of the machine 10. According to a next block 82, the impact wear plate 68 may be directly affixed to the bottom surface 60 of one of the legs 58 of the upper yoke 38 using a suitable method apparent to those with ordinary skill in the art such as, but not limited to, adhesive bonding, mechanical fastening, welding, or brazing. Alternatively, the impact wear plate 68 may be affixed to the backing plate 70 such as by adhesive bonding, mechanical fastening, welding, or brazing (block 84). The impact wear plate 68 assembled with the backing plate 70 may then be affixed to the bottom surface 60 with the backing plate 70 making direct contact with the bottom surface 60 (block 86). The assembly of the impact wear plate 68 and the backing plate 70 may be affixed to the bottom surface 60 using any suitable method such as, but not limited to, adhesive bonding, mechanical fastening, welding, and brazing. In other arrangements, the backing plate 70 may be first affixed to the bottom surface 60, and the impact wear plate 68 may be subsequently affixed to the backing plate 70. The installation of the impact wear plates 68 on the compactor 12 as described above may be repeated as needed to affix an impact wear plate 68 to each of the legs 58 of the upper yoke 38.

During use of the vibratory plate compactor 12, the base plate 42 may vibrate to compact the work surface 14. When downward forces are applied on the compactor 12, the base plate 42 and the upper yoke 38 may strike each other, and the impact wear plates 68 may absorb at least some of the shock loads to protect the base plate 42 and the upper yoke 38 from wear. With continued use, the impact wear plates 68 may become worn or damaged, and may be replaced according to an optional block 88.

The impact wear plates disclosed herein may be affixed to the upper portion of the vibratory plate compactor to absorb shock loads upon impact between the upper portion and the lower portion of the compactor during use. More specifically, the impact wear plates may be affixed to the bottom surfaces of the upper yoke legs that tend to strike the base plate 42 when a downward force is applied on the compactor during vibration of the base plate 42. As opposed to metal "feet" of the prior art, the impact wear plates disclosed herein may be fabricated from a non-metallic material to avoid metal to metal contacts when strikes occur. The impact wear plates disclosed herein may prevent gouges, rust, and/or paint chipping at the upper yoke and the base plate. Further, the impact wear plates may serve as a back stop when the base plate and the upper yoke strike each other, thereby limiting the stretching of the isolator mounts and protecting the isolator mounts from wear. The impact wear plates disclosed herein provide a serviceable item that may be readily replaced when worn down from continued use.

It is expected that the technology disclosed herein may find wide industrial applicability in a wide range of areas such as, but not limited to, construction, road construction, building, agriculture, and earth-moving equipment applications.

What is claimed is:

1. A vibratory plate compactor, comprising:

a base plate configured to vibrate and compact a work surface;

an upper yoke having at least one leg with a bottom surface disposed above and facing the base plate; and an impact wear plate affixed to the bottom surface of the at least one leg, the impact wear plate being unattached to the base plate and being at least partially formed from a non-metallic material.

2. The vibratory plate compactor of claim 1, wherein the upper yoke includes a plurality of the legs, and a plurality of the impact wear plates each affixed to the bottom surface of a respective one of the legs.

3. The vibratory plate compactor of claim 1, wherein the non-metallic material is polyurethane.

4. The vibratory plate compactor of claim 1, wherein the non-metallic material is natural rubber.

5. The vibratory plate compactor of claim 1, wherein the non-metallic material is selected from natural rubber and a synthetic rubber.

6. The vibratory plate compactor of claim 1, wherein the impact wear plate is adhesively bonded to the bottom surface of the leg.

7. The vibratory plate compactor of claim 1, wherein the impact wear plate is mechanically fastened to the bottom surface of the leg.

8. The vibratory plate compactor of claim 1, wherein the impact wear plate is affixed to a backing plate, and wherein the impact wear plate and the backing plate are affixed to the bottom surface with the backing plate contacting the bottom surface.

9. The vibratory plate compactor of claim 1, wherein the impact wear plate has a thickness ranging from about 30 millimeters (mm) to about 100 mm.

10. The vibratory plate compactor of claim 9, wherein the impact wear plate has a length ranging from about 100 mm to about 500 mm.

11. A machine, comprising:

an internal combustion engine;

an undercarriage supporting tracks or wheels;

a boom;

a vibratory plate compactor coupled to an end of the boom, the vibratory plate compactor including a lower portion having a base plate and a vibratory mechanism configured to vibrate the base plate, the vibratory plate compactor further including an upper portion having an upper yoke with a plurality of legs each having bottom surfaces facing the base plate; and a plurality of impact wear plates each affixed to the bottom surface of a respective one of the legs of the upper yoke, the impact wear plates being unattached to the base plate and being formed from a non-metallic material.

12. The machine of claim 11, wherein the non-metallic material is polyurethane.

13. The machine of claim 11, wherein the non-metallic material is selected from natural rubber and a synthetic rubber.

14. The machine of claim 11, wherein each of the impact wear plates are adhesively bonded to a respective one of the legs.

15. The machine of claim 11, wherein each of the impact wear plates are mechanically fastened to a respective one of the legs.

16. The machine of claim 11, wherein each of the impact wear plates are adhesively bonded to a backing plate, and wherein the impact wear plate and the backing plate are affixed to the bottom surface by adhesive bonding or mechanical fastening.

17. The machine of claim 11, wherein the machine further comprises a plurality of isolator mounts interconnecting the upper portion and the lower portion of the vibratory plate compactor, each of the isolator mounts being affixed to both the upper portion and the lower portion, the isolator mounts being configured to dampen vibrations from the lower portion to the upper portion.

18. The machine of claim 17, wherein each of the isolator mounts includes a damping portion formed from an elastomeric material.

19. The machine of claim 18, wherein the lower portion includes support plates extending substantially perpendicular to the base plate, and wherein each of the isolator mounts are affixed to one of the support plates and one of the legs of the upper yoke.

20. A machine configured to compact a work surface, comprising:

an internal combustion engine;

an undercarriage supporting tracks or wheels;

a rotatable turntable configured to rotate with respect to the undercarriage;

a boom connected to the rotatable turntable;

a vibratory plate compactor coupled to an end of the boom, the vibratory plate compactor including a base plate and a vibratory mechanism operatively associated with the base plate and configured to vibrate the base plate, the vibratory plate compactor further comprising an upper yoke with at least one leg having a bottom surface facing the base plate;

a metal backing plate affixed to the bottom surface of the leg; and an impact wear plate affixed to the metal backing plate, the impact wear plate being unattached to the base plate and being formed from a wear-resistant material.

* * * * *